US007772948B2

(12) United States Patent
Grow et al.

(10) Patent No.: US 7,772,948 B2
(45) Date of Patent: Aug. 10, 2010

(54) SELF-CLINCHING MAGNET

(75) Inventors: Roger H. Grow, Lafayette, CO (US); Daniel J. Plutt, Superior, CO (US)

(73) Assignee: Oracle America, Inc., Redwood City, CA (US)

( * ) Notice: Subject to any disclaimer, the term of this patent is extended or adjusted under 35 U.S.C. 154(b) by 821 days.

(21) Appl. No.: 11/496,226

(22) Filed: Jul. 31, 2006

(65) Prior Publication Data

US 2008/0055030 A1 Mar. 6, 2008

(51) Int. Cl.
*H01F 7/20* (2006.01)
*A44B 17/00* (2006.01)

(52) U.S. Cl. ..... 335/285; 24/303

(58) Field of Classification Search ..... 335/285, 335/286–289; 24/303
See application file for complete search history.

(56) References Cited

U.S. PATENT DOCUMENTS

| | | | | |
|---|---|---|---|---|
| 4,825,526 | A * | 5/1989 | Shenier et al. | 335/285 |
| 6,009,601 | A * | 1/2000 | Kaufman | 24/303 |
| 6,174,117 | B1 * | 1/2001 | Kawatani et al. | 411/107 |
| 6,295,702 | B1 * | 10/2001 | Bauer | 24/303 |
| 6,677,692 | B1 * | 1/2004 | Sato et al. | 310/89 |
| 6,876,512 | B2 * | 4/2005 | Gavit et al. | 360/96.61 |

OTHER PUBLICATIONS

PennEngineering, "PEM® Brand Fasteners Installation Demo," 2003, 1 page.

PennEngineering, "PEM® Brand Fasteners," 2002-2003, 16 pages.

Smarthome, "No More Ugly Alarm Contact Switches," 1995-2006, 3 pages.

George Risk Industries, "180 Series ¾" and 1" Steel Door Recessed Switch Sets," Feb. 2, 2005, 4 pages.

Electronix Express, "Magnetic Switch," Apr. 17, 2003, 2 pages.

PennEngineering, PEM® Brand Fasteners, 2002-2003, 2 pages.

PennEngineering, "Floating, Self-Clinching Fasteners; Bulletin," ALA 505 Revised 406, 2005, 4 pages.

PennEngineering, "Nylon Insert, Self-Locking Fasteners; Bulletin," PL 505 Revised 406, 2005, 6 pages.

"Self-Clinching Nuts," 1 page downloaded from http://www.machinedesign.com/BDE/FASTENING/bdefj3/bdefj3_9.html, May 16, 2006.

(Continued)

*Primary Examiner*—Elvin G Enad
*Assistant Examiner*—Bernard Rojas
(74) *Attorney, Agent, or Firm*—Robert C. Kowert; Meyertons, Hood, Kivlin, Kowert & Goetzel, P.C.

(57) ABSTRACT

In various embodiments, a self-clinching magnet (SCM) may be used to mount a magnet in a panel or for use in alignment. The SCM may include an outer shell with a clinching portion and an inner magnetic core. The clinching portion may hold the SCM in a hole in a panel by engaging sidewalls in the hole. The clinching portion may be positioned on the outer shell of the SCM so the SCM is flush with a side of the panel when the SCM is inserted into the panel. The SCM may be mounted in a door and a switch may be mounted to detect when the door is open or closed (by detecting the presence of the magnet). The SCM may also be used to align a tape magazine in a receiver.

18 Claims, 10 Drawing Sheets

OTHER PUBLICATIONS

Master Magnetics, Inc., "Packaged Magnets for Hardware/Home Improvement Retail Markets," 2 pages downloaded Jul. 27, 2006 from http://www.magnetsource.com/Consumer%20Pages/HARDWARE%20MAGS.html.

Master Magnetics, Inc., "Packaged Magnets for Craft, Hobby and Office Supply Retail Markets," 2 pages downloaded Jul. 27, 2006 from http://www.magnetsource.com/Consumer%20Pages/CRAFT_MAGNETS.html.

Master Magnetics, Inc., "Super Latch Magnets," 2 pages downloaded Jul. 27, 2006 from http://www.magnetsource.com/Consumer%20Pages/Super_Latches.html.

The PhysLink.com Science eStore, "Plastic-Encased Bar Magnet," 1995-2006, 3 pages.

"The Gadgets Page," 2003-2005 Michael Moncur, Matthew Strebe, and The Gadgets Page, 4 pages.

* cited by examiner

SELF-CLINCHING MAGNET

BACKGROUND OF THE INVENTION

1. Field of the Invention

The present invention relates to magnets and, more specifically, to a self-clinching magnet and applications thereof in sheet material, such as for use in a computer system or computer storage system.

2. Description of the Related Art

Computer assemblies may include various components mounted inside a cabinet. Some computer assemblies may include cabinets with rack-mounted equipment. These assemblies may also use magnets to secure doors and various components on the cabinets. In addition, other assembly types may use magnets to secure various components. For example, medicine cabinets use a magnet to keep a door on the medicine cabinet closed. Magnets may also be used in conjunction with switches. For example, a switch sensitive to the presence of a magnet may operate to detect the presence of a magnet in a closed door (or the absence there of if the door is open). House alarm systems may use these magnets in either the door or doorframe with a corresponding switch to detect when the door is opened/closed.

The installation of magnets for applications as noted above may involve several difficulties. For example, attaching a magnet may include using an adhesive to glue the magnet to a cabinet or frame. Alignment problems may exist with such adhesively-attached magnets since the magnet may move as it is being place and/or before the adhesive cures. Another technique used to attach a magnet in for applications as noted above includes encasing the magnet in a plastic "mushroom" case that is snap-fitted into an opening in the cabinet or frame. The back portion of the plastic magnet casing may protrude from the surface in which it is mounted which may be undesirable for some applications. Also, when mounted in sheet metal, such plastic casing may come loose and rotate, vibrate or otherwise move. Moreover, some plastic magnet casing may be prone to cracking which may lead to the magnet moving or falling from its mounted location. Moreover, plastic magnet casing may not be appropriate for some painting processes, such as powder-coated painting, which require baking. The above-noted irregularities with existing magnet mounting techniques may result in a misalignments and/or offsets which may affect both the aesthetic appearance and the functionality of an installed magnet.

SUMMARY

In various embodiments, a self-clinching magnet (SCM) may be used to mount a magnet in a panel (e.g., a panel in a cabinet). The SCM may include an outer shell with a clinching portion and an inner magnetic core. The clinching portion may hold the SCM in a hole of a panel by engaging sidewalls in the hole. The clinching portion may be positioned on the outer shell of the SCM so the magnet is flush with a side of the panel when the SCM is inserted into the panel.

In some embodiments, the SCM may be used with a switch designed to detect the presence of magnets. The SCM may be mounted in a door and the switch may be mounted to detect when the door is opened or closed (e.g., by detecting the presence of the magnet). The SCM may be powder coated, painted, and/or covered with putty to conceal it from view.

In some embodiments, the SCM may be used to align a tape magazine in a receiver. For example, the SCM may be mounted on one of the tape magazine and the receiver and a metal plate may be mounted on the other of the tape magazine and the receiver such that when the SCM and metal plate come in close proximity, they attract each other and align the tape magazine with the receiver (e.g., during insertion of the tape magazine into the receiver).

BRIEF DESCRIPTION OF THE DRAWINGS

A better understanding of the present invention may be obtained when the following detailed description is considered in conjunction with the following drawings, in which.

Figure 1A:
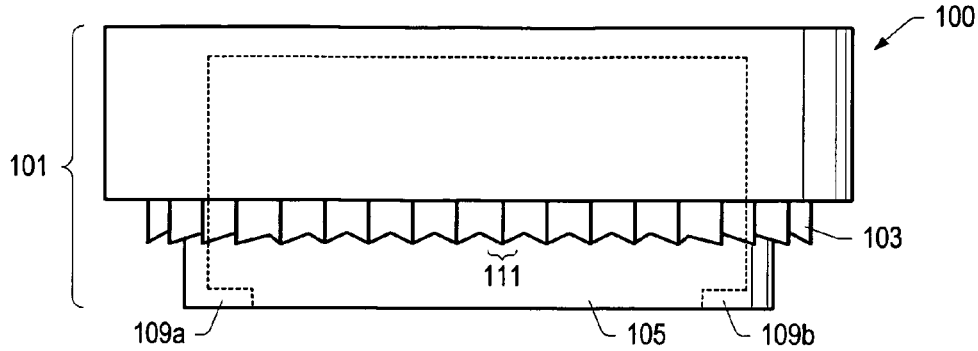
FIGS. 1*a*-1*e* illustrate several embodiments of an SCM.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims. Note, the headings are for organizational purposes only and are not meant to be used to limit or interpret the description or claims. Furthermore, note that the word "may" is used throughout this application in a permissive sense (i.e., having the potential to, being able to), not a mandatory sense (i.e., must). The term "include", and derivations thereof, mean "including, but not limited to". The term "coupled" means "directly or indirectly connected".

DETAILED DESCRIPTION OF EMBODIMENTS

FIGS. 1*a-d* illustrate embodiments of a self-clinching magnet (SCM) 100. In some embodiments, the SCM 100 may include an outer shell 101 at least partially surrounding an inner magnetic core (outlined by the dashed line) 105. The outer shell 101 may include a clinching portion 103 configured to secure the SCM 100 in a hole (e.g., in a panel) by engaging sidewalls of the hole. In some embodiments, at least one surface of the inner magnetic core 105 in the SCM 100 may be flush with a bottom of the SCM 100.

In some embodiments, the outer shell 101/clinching portion 103 of the SCM 100 may be made of steel (e.g., carbon steel, stainless steel, tool steel, high strength, low alloy (HSLA) steel, etc.). Other materials may also be used. The material used for the outer shell 101/clinching portion 103 may have a greater hardness than a material in a panel the SCM 100 will engage. The outer shell 101/clinching portion 103 may be made of one material or may comprise separate materials (e.g., the upper and lower parts of the outer shell 101 may be made of different materials or the outer shell 101 and clinching portion 103 may comprise different materials). The inner magnetic core 105 may be made of a ferromagnetic material, ceramic magnet, rare earth magnet, or an electromagnet. Other materials are also possible for the inner magnetic core 105. In some embodiments, the outer shell 101, clinching portion 103, and inner magnetic core 105 may be integrally made of a single magnetic material.

In some embodiments, the clinching portion 103 may be arranged on the SCM 100 such that when the SCM 100 is engaged with a hole in the panel, one surface of SCM 100 is substantially flush with a surface of the panel. In some embodiments, the clinching portion 103 may be arranged on the SCM 100 to offset a surface of the inner magnetic core 105 with the surface of the panel when the SCM 100 is engaging the hole in the panel (e.g., to cause the surface of the inner magnetic core 105 to protrude from or be depressed in the hole). The clinching portion 103 may comprise serrated teeth 111. In some embodiments, other clinching portion configurations may be used instead of serrated teeth 111 to grip the sidewalls (e.g., the clinching portion 103 may be made of a pliable plastic that engages the sidewalls without deforming the sidewalls).

FIG. 1*a* illustrates an embodiment of the SCM 100 with wraparounds 109*a,b* used to retain the inner magnetic core 105 in the interior of the SCM 100. In some embodiments, the outer shell 101 may be formed around a portion of the inner magnetic core 105 or may be formed with an opening to receive the inner magnetic core 105. For example, the wraparounds 109*a,b* may be portions of the outer shell 101 that were cold rolled over the inner magnetic core 105 once the inner magnetic core 105 was inserted into an opening in the outer shell 101.

Figure 1B:
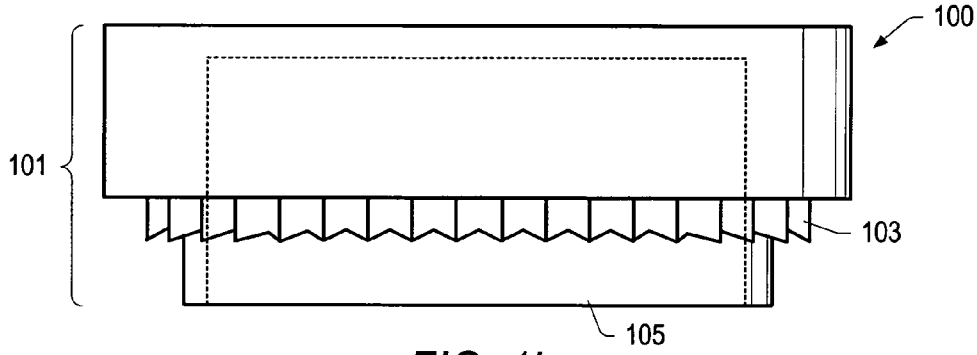
Figure 1C:
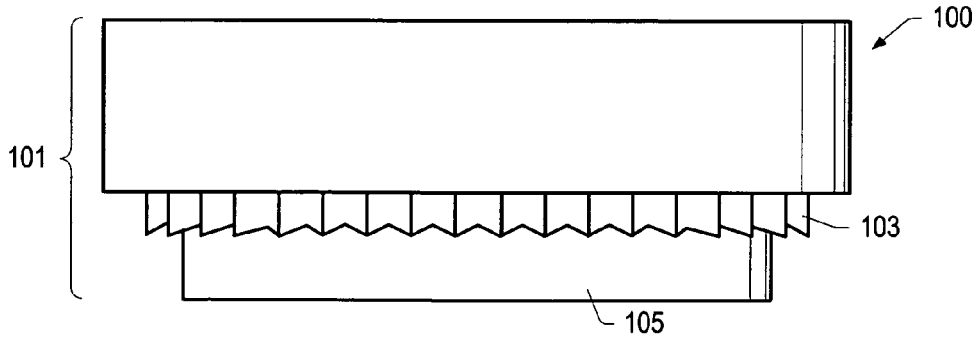
Figure 1D:
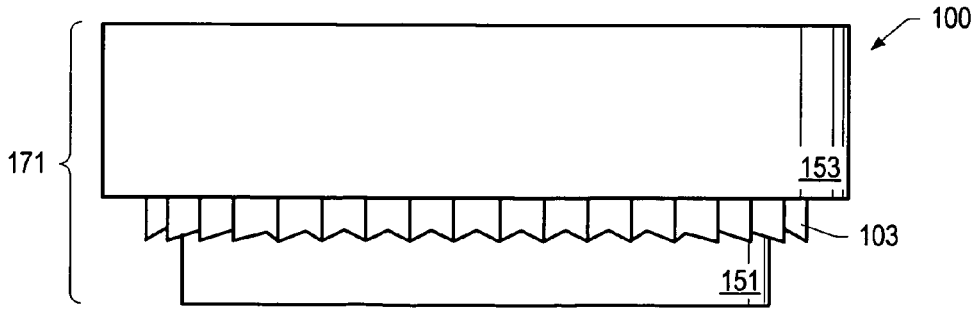
Figure 1E:
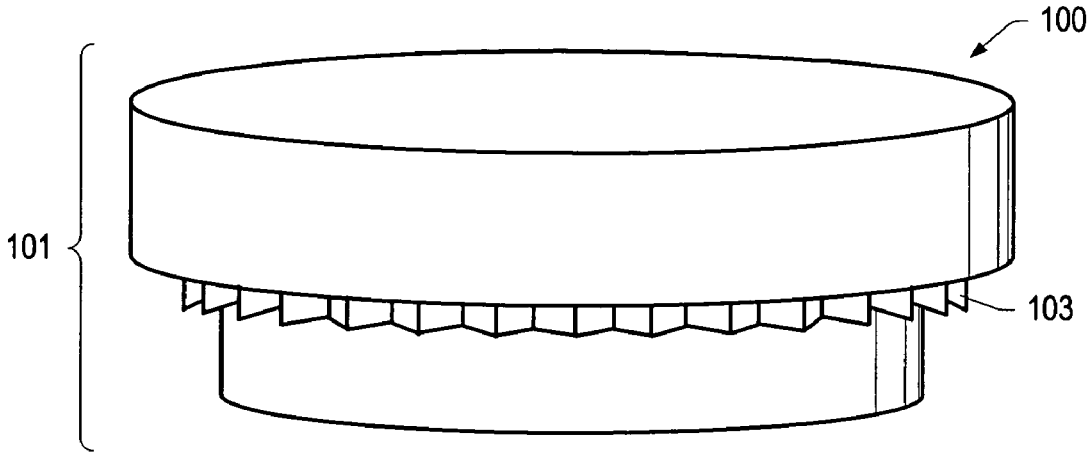

FIG. 1*b* illustrates an embodiment without wraparounds 109*a,b*. For example, the inner magnetic core 105 may be retained in an opening in the SCM 100 through an adhesive. Other retention mechanisms are also contemplated. FIG. 1*c* illustrates an embodiment in which the outer shell 101 and inner magnetic core 105 are comprised in a single piece (e.g., the entire SCM 100 may be made of a magnetic material). As seen in FIG. 1*d*, the outer shell 171 may include portion 153 and clinching portion 103 coupled to a lower inner magnetic core 151 (in this example, the outer shell 171 may engage a limited part of the outer perimeter of the inner magnetic core 151). The inner magnetic core 151 may be coupled to the outer shell 171 and/or clinching portion 103 through an adhesive or other fastener. FIG. 1*e* illustrates an isometric view of an embodiment of the SCM 100 (e.g., as seen in FIGS. 1*a* and 1*b*).

Figure 2A:
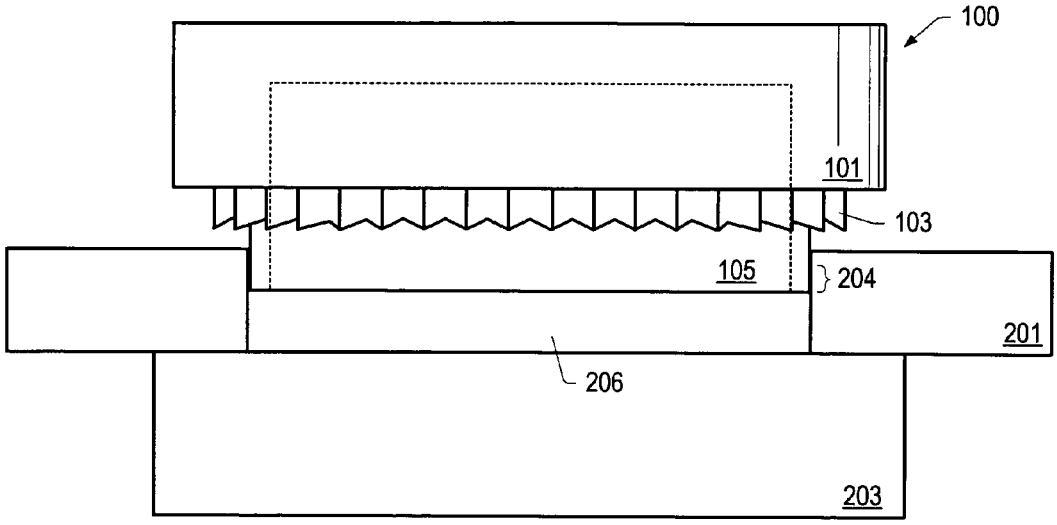
FIGS. 2*a*-2*c* illustrate a SCM being installed, according to an embodiment.
Figure 2B:
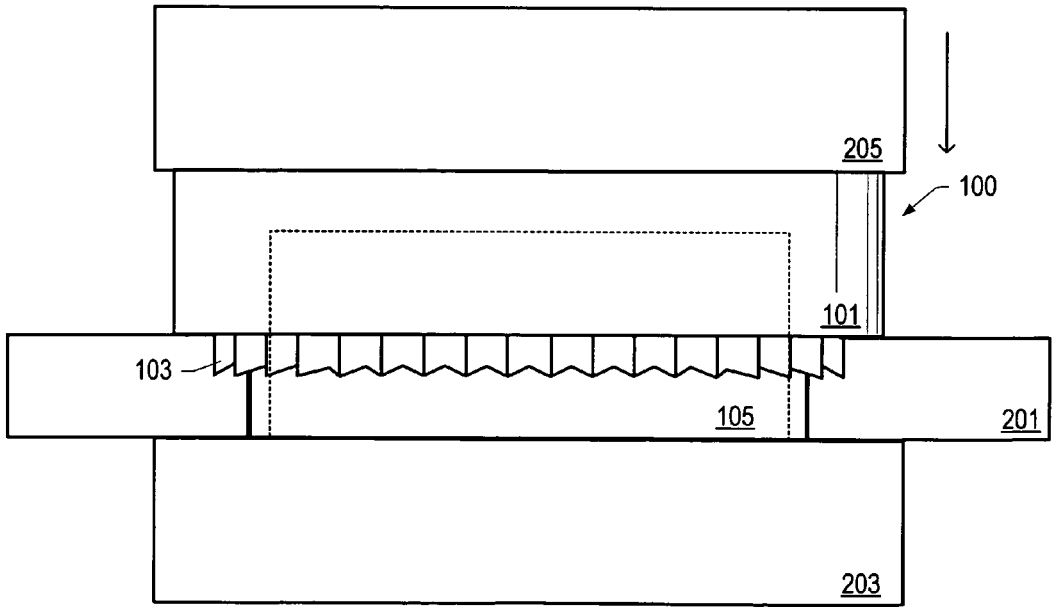
Figure 2C:
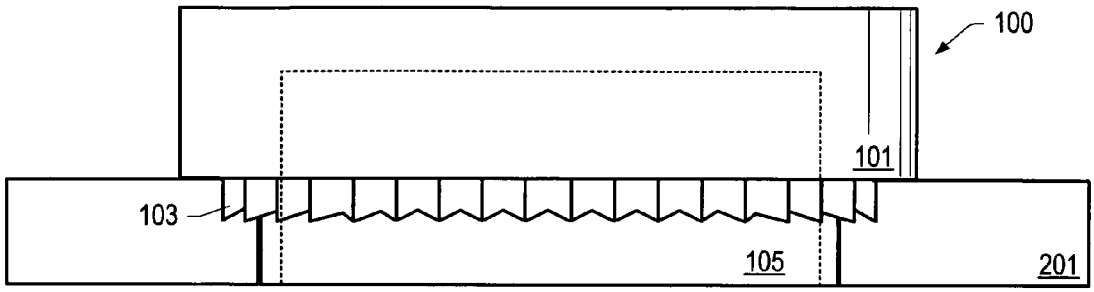
Figure 2D:
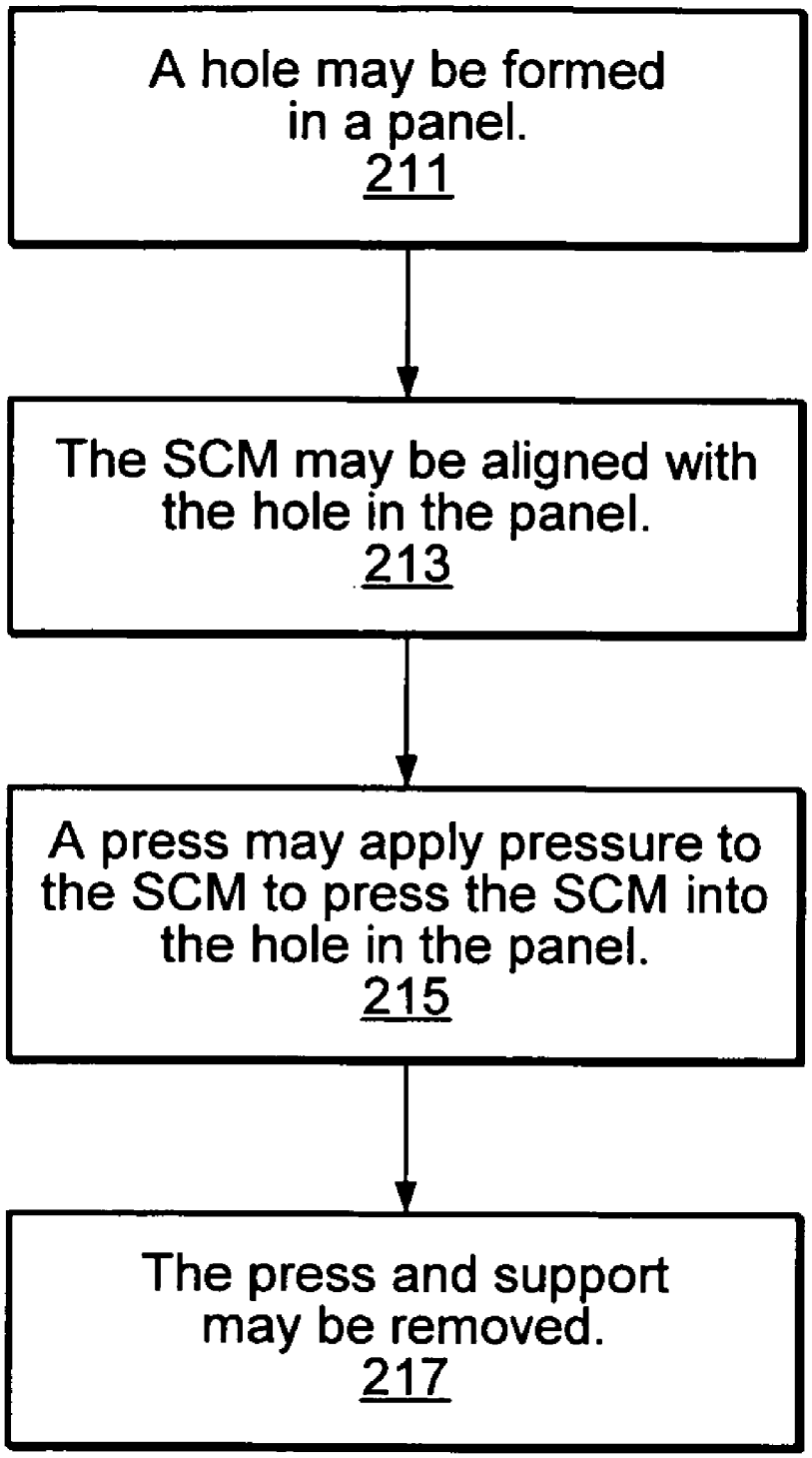
FIG. 2*d* illustrates a method for installing the SCM, according to an embodiment.

FIGS. 2*a*-2*c* illustrate an embodiment of the SCM 100 being installed in a panel. FIG. 2*d* illustrates an embodiment of a method for installing the SCM 100. It should be noted that in various embodiments of the methods described below, one or more of the elements described may be performed concurrently, in a different order than shown, or may be omitted entirely. Other additional elements may also be performed as desired.

At 211, a hole 206 may be formed in a panel 201. For example, the hole 206 may be a punched hole in the sheet metal panel 201. An operator may preset the location and size of the hole(s) 206 for the SCM 100 and a machine may accurately stamp the hole(s) 206 to insure consistency among several panels. An automated stamping process may also accelerate installation of the SCMs 100 by pre-stamping the holes 206. Other fabrication methods are also contemplated for forming holes in the panel 201 (e.g., the panel may be formed with the holes 206).

At 213, the SCM 100 may be aligned with the hole 206 in the panel 201. As seen in FIG. 2*a*, the panel 201 may be placed on a support 203. For example, the support 203 may be aligned to provide support at least substantially around the hole 206 in the panel 201.

At 215, a press 205 may apply pressure to the SCM 100 to press the SCM 100 into the hole 206 in the panel 201. As seen in FIG. 2*b*, the SCM 100 may be pressed into the panel 201 until the clinching portion 103 engages the sides of the panel 201. The SCM 100 may be pressed into the panel 201 until the outer shell 101 is flush with a bottom of the panel 201. The clinching portion 103 may cut into and/or deform the sidewalls of the panel 201. The clinching portion 103 may also deform as it engages the panel 201. In some embodiments, only the clinching portion 103 or only the sidewalls may deform as they engage.

At 217, the press 205 and support 203 may be removed. As seen in FIG. 2*c*, the SCM 100 may then be left with an inner magnetic core 105 substantially flush with a side of the panel 201. The engaged clinching portion 103 may provide a reliable, rugged connection to hold the SCM 100 in place.

In some embodiments, the SCM 100 may be pressed into a panel 201 without a pre-stamped hole. For example, the lower edges 204 of the SCM 100 may be sufficiently sharp and/or have a sufficient hardness to punch through panel 201. The clinching portion 103 may engage the sides of the SCM 100 punched hole to hold SCM 100 in place.

Figure 3:
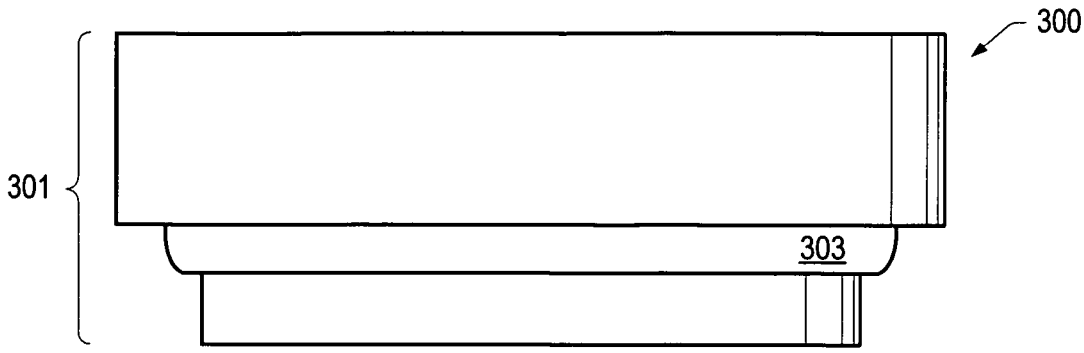
FIG. 3 illustrates a configuration of a SCM, according to an embodiment.
Figure 4:
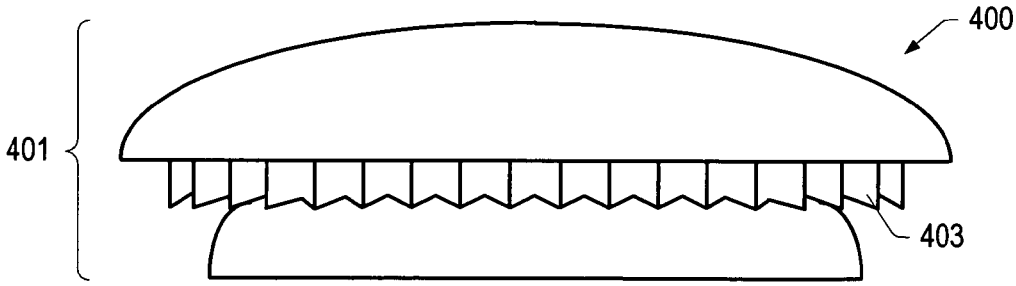
FIG. 4 illustrates another configuration of a SCM, according to an embodiment.
Figure 5:
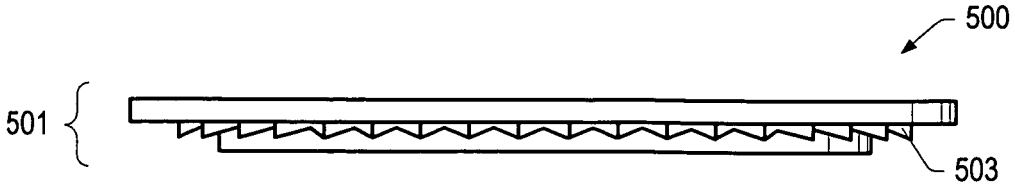
FIG. 5 illustrates another configuration of a SCM, according to an embodiment.

FIG. 3 illustrates an embodiment of a configuration of a SCM. As seen in FIGS. 3-5, the dimensions, shapes, and sizes of the SCM may be varied to fit particular needs. For example, SCM 300 is shown with an outer shell 301 having a round clinching portion 303 that may be used for clinching portions made of a pliable plastic (e.g., to use if the SCM is used on a temporary basis). FIG. 4 illustrates an embodiment of another configuration of an SCM. SCM 400 is shown with a rounded upper outer shell 401 with clinching portion 403. The outer shell 401 may be shaped as needed for the placement of the SCM 400. For example, the shape may be configured to more easily conceal the presence of the SCM 400. FIG. 5 illustrates an embodiment of another configuration of an SCM. SCM 500 is shown with a thin outer shell 501 with a thin clinching portion 503 (e.g., for use with thin panels). Each of the embodiments illustrated in FIGS. 3-5 may include a magnetic core.

Figure 6A:
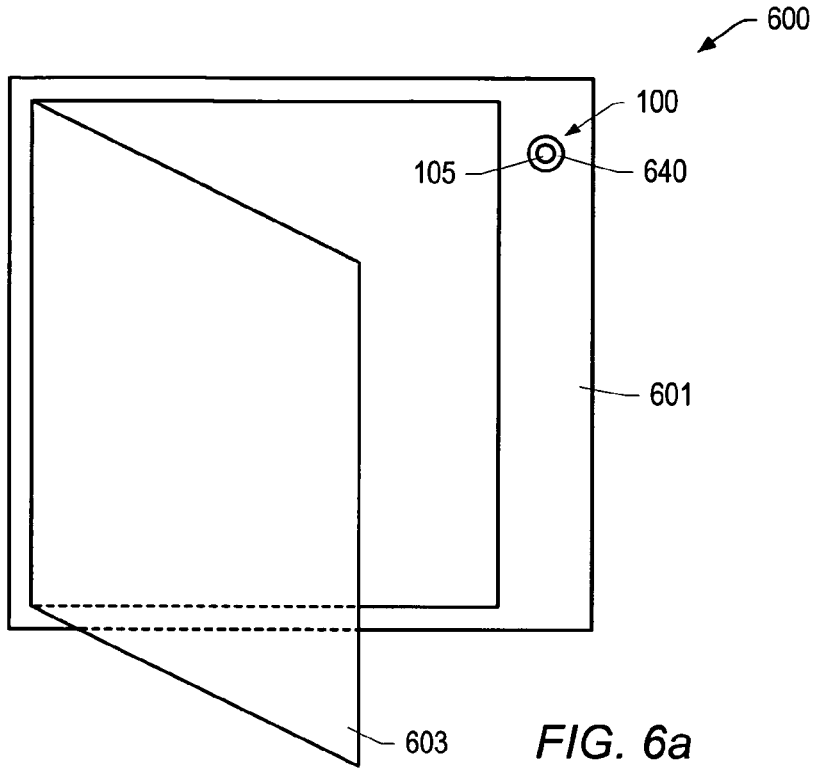
FIG. 6*a* illustrates a SCM installed on a cabinet doorframe, according to an embodiment.

FIG. 6*a* illustrates an embodiment of the SCM 100 installed on a cabinet doorframe 601. For example, the cabinet may be a cabinet for a computer system or computer storage system (e.g., disk array, automated tape library, etc.). The SCM 100 may be installed into the doorframe 601 with the inner magnetic core 105 of the SCM 100 flush with an exterior of the doorframe 601. The cabinet door 603 may be metal and may be attracted to the inner magnetic core 105 of the SCM 100. The inner magnetic core 105 may hold the door 603 closed when the door is in close proximity to the SCM 100. In some embodiments, the SCM 100 may be used to keep a door open when the door is in close proximity (e.g., the SCM 100 may be placed in a location where it will attract the door when the door is in an open position). The hole for the SCM 100 and/or the SCM 100 may be installed automatically by machine to accelerate a fabrication process for the cabinets.

In some embodiments, the SCM 100 may thus give the cabinet a more professional appearance (e.g., over a simple magnet glued to the cabinet), may be easier to service (e.g., to access a circuit board or replace a component in the cabinet 600), and/or provide electromagnetic (EM) shielding. In some embodiments, the portion of the outer shell 101 and the portion of the inner magnetic core 105 that are substantially flush with an outer surface of the panel may receive a coating 640 such as a powder coating (for heat resistance), paint, and/or putty to conceal the SCM 100. Other coatings are also contemplated.

Figure 6B:
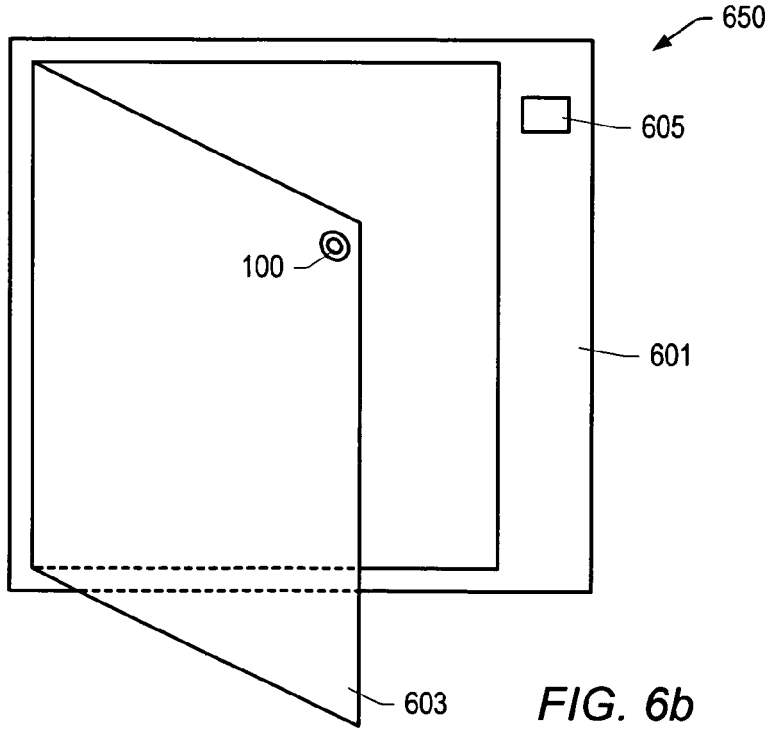
FIG. 6*b* illustrates a SCM installed on a cabinet door with a corresponding doorframe switch, according to an embodiment.

FIG. 6*b* illustrates an embodiment of the SCM 100 installed on a cabinet door 603 with a corresponding doorframe switch 605 installed on a doorframe 601. The SCM 100 may be installed on the cabinet door 603 with the inner magnetic core 105 flush with an interior of the door 603. In some embodiments, the switch 605 may be installed on the door 603 and the SCM 100 may be installed on the doorframe 601. The switch 605 may detect the presence of the inner magnetic core 105 on the SCM 100 when the door 603 is in close proximity to the switch 605 on the cabinet 650. The switch 605 or a different part of the doorframe 601 engaging the inner magnetic core 105 of the SCM 100 may be metal (and/or attracted to the inner magnetic core 105). The switch 605 may be used, for example, to shut down a computer system in the cabinet or generate an alarm/warning if the door 603 is opened.

Figure 7A:
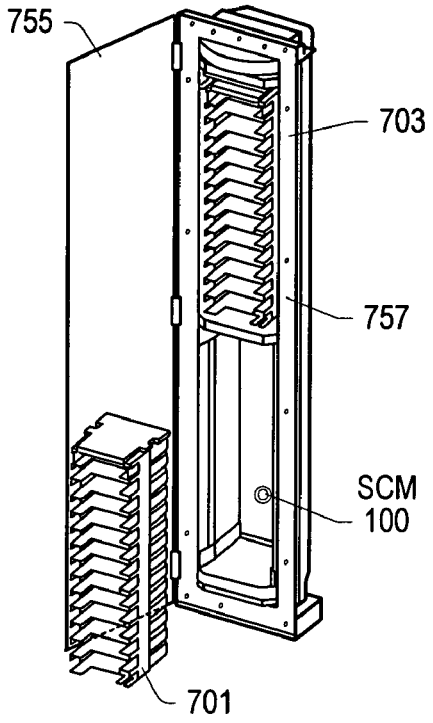
FIGS. 7*a-c* illustrate a SCM and metal plate used on a tape magazine, according to an embodiment.
Figure 7B:
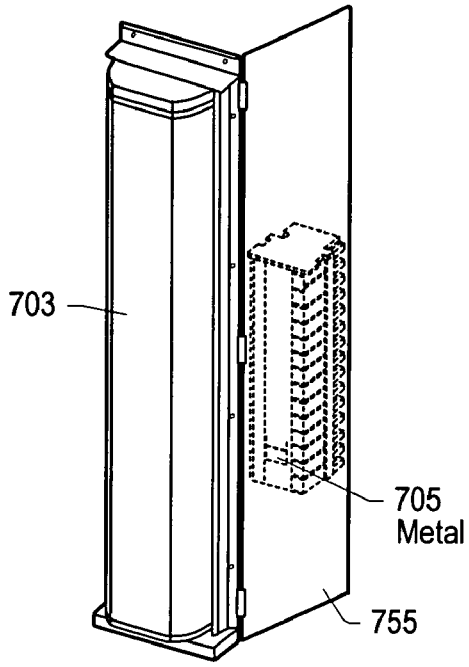
Figure 7C:
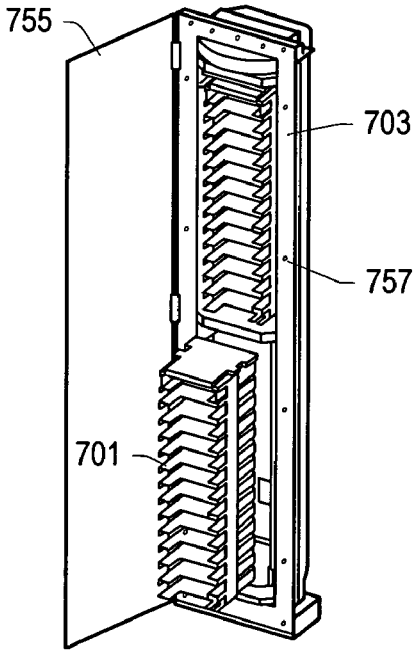

FIGS. 7*a-c* illustrate another use for the SCM 100, specifically, for aligning a tape magazine 701 in a receiver 703. FIGS. 7*a-c* illustrate an embodiment of the SCM 100 and a metal plate 705. The receiver 703 may be configured to receive one or more tape magazines 701. The tape magazine 701 may hold at least one storage medium (e.g., a data tape). As seen in FIG. 7*a,* an SCM 100 may be installed on a tape magazine 701 or receiver 703. As seen in FIG. 7*b,* a metal plate 705 may be installed on the other of the tape magazine 701 or receiver 703. For example, the metal plate may be glued to the back of the tape magazine 701 as shown in FIG. 7*b.* In some embodiments, at least one of the tape magazine 701 or receiver 703 may be made of metal and a separate metal plate 705 may not be needed. As seen in FIG. 7*c,* the tape magazine 701 may be placed in a receiver 703. The magnetic effect of the SCM may help guide, or bias, the tape magazine 701 into the correct location in the receiver. An SCM 100 may also be used on a door 755 or doorframe 757 of the receiver 703. For example, as described with respect to FIG. 6*b,* a switch may be installed on the doorframe 757 of the tape magazine 701 to detect an inner magnetic core 105 on the SCM on the door 755 of the receiver 703.

Figure 8A:
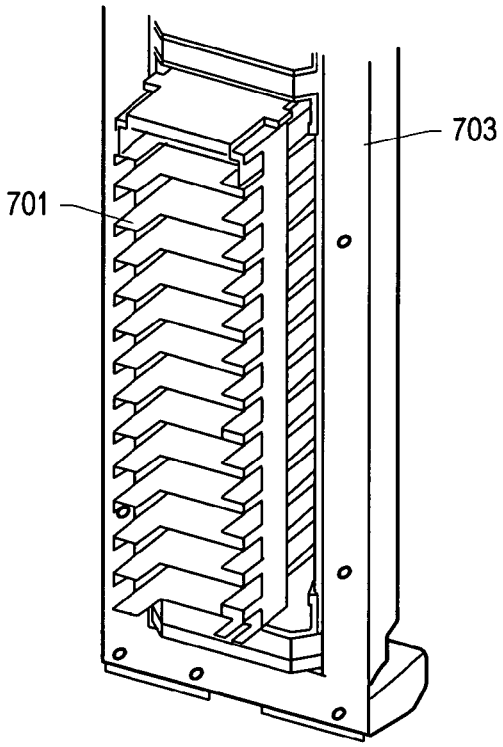
FIGS. 8*a-c* illustrate installing and aligning the tape magazine with a carrier, according to an embodiment.
Figure 8B:
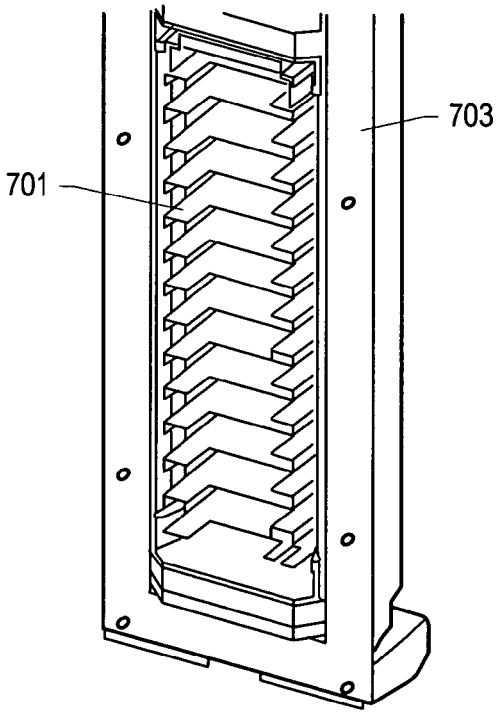
Figure 8C:
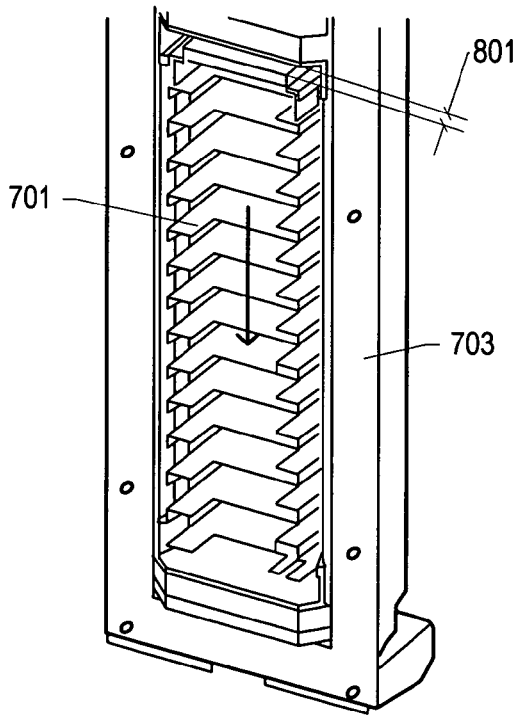
Figure 9:
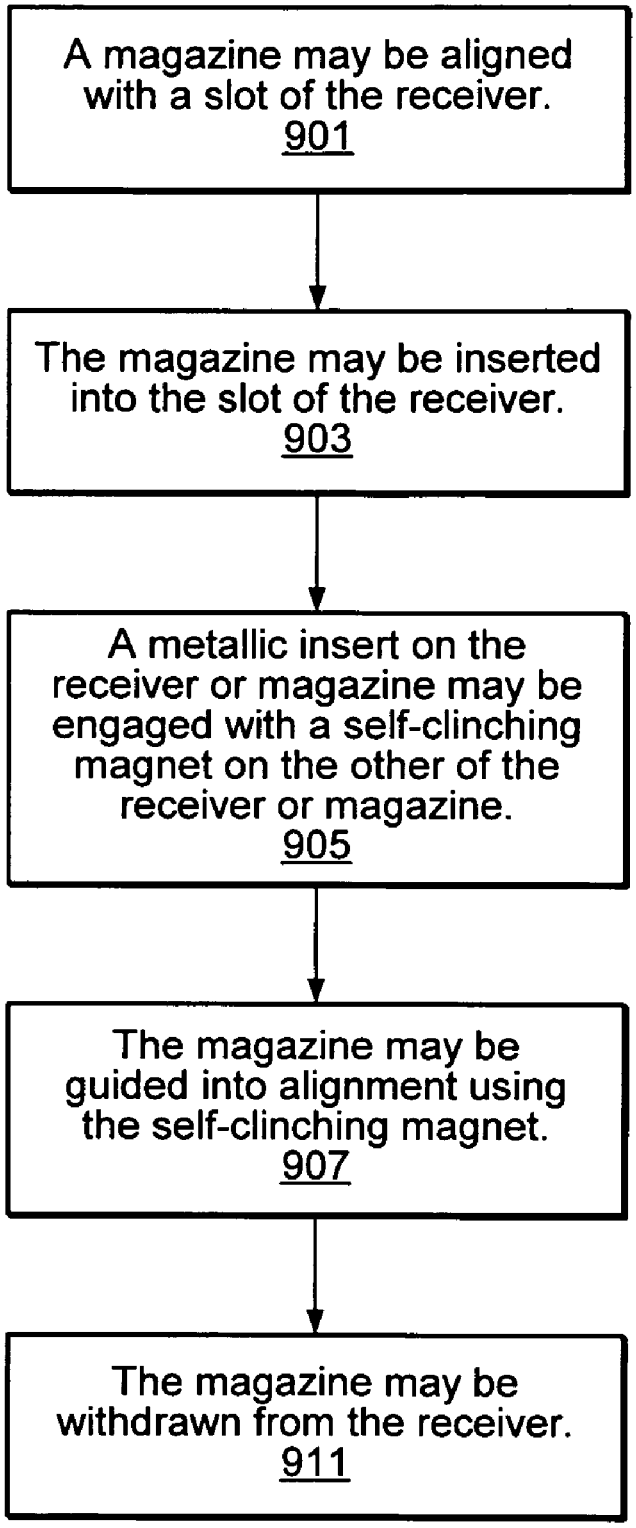
FIG. 9 illustrates a method for using a SCM to align a tape magazine, according to an embodiment.

FIGS. 8*a-c* illustrate an embodiment of installing and aligning the tape magazine with a carrier. FIG. 9 illustrates an embodiment of a method for using the SCM to align a tape magazine with a receiver. It should be noted that in various embodiments of the methods described below, one or more of the elements described may be performed concurrently, in a different order than shown, or may be omitted entirely. Other additional elements may also be performed as desired.

At 901, a magazine 701 may be aligned with a slot of the receiver 703. As seen in FIG. 8*a,* the tape magazine 701 may be aligned with the slot in the receiver 703.

At 903, the magazine 701 may be inserted into the slot of the receiver 703. As seen in FIG. 8*b,* the tape magazine 701 is pushed into the tape receiver slot until it touches a back wall of the receiver 703.

At 905, a metallic insert on the receiver 703 or magazine 701 may be engaged with a self-clinching inner magnetic core on the other of the receiver 703 or magazine 701. The metal 705 may engage an inner magnetic core 105 the SCM 100 when the magazine 701 touches the back of the receiver 703.

At 907, the tape magazine 701 may be guided into alignment using the SCM 100. In some embodiments, the SCM 100 on the receiver 703 may pull on the metal 705 on the tape magazine 701 to pull the tape magazine 701 into alignment against the back of the receiver 703. This may align the back of the tape magazine 701 with the back of the receiver 703 in a correct location. As seen in FIG. 8*c,* the received tape magazine 701 may rest on the bottom of the receiver. The tape magazine 701 may move in a vertical direction (e.g., downward) after being aligned by the SCM 100. For example, tape magazine 701 may have moved downward a distance 801.

At 911, the tape magazine 701 may be withdrawn from the receiver 703. As the tape magazine 701 is withdrawn from the receiver 703, the SCM 100 and metal plate 705 may disengage.

A self-clinching magnet as described herein may be used for other assembly guiding or biasing applications as well, for example to assist in guiding one part into a correct receiving location for the part. The SCM may be located on the part or the receiver or both.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A self-clinching magnet (SCM), comprising:
an outer shell comprising a clinching portion; and
an inner magnetic core coupled within the outer shell;
wherein the clinching portion is operable to engage a sidewall of a hole in a panel to hold the SCM in the panel by physically gripping the sidewall of the hole; and
wherein the clinching portion comprises at least two teeth which are operable to at least partially deform at least a portion of the sidewall of the hole to engage the hole.

2. The SCM of claim 1, wherein a surface of the self-clinching magnet is configured to be substantially flush with an outer surface of the panel when the clinching portion engages the sidewall of the hole in the panel.

3. The SCM of claim 1, wherein the inner magnetic core is coupled to the outer shell through an adhesive.

4. The SCM of claim 1, wherein the outer shell at least partially circumscribes the inner magnetic core.

5. The SCM of claim 1, wherein the outer shell is comprised of steel.

6. The SCM of claim 1, wherein the outer shell and inner magnetic core are both comprised in a single magnetic member.

7. A system, comprising:
an access panel of a computer system, wherein the access panel comprises a hole;
a self-clinching magnet (SCM), comprising:
an outer shell comprising a clinching portion;
an inner magnetic core;
wherein the clinching portion engaged in an interior of the hole in the access panel to hold the SCM in the access panel by physically gripping a sidewall of the hole.

8. The system of claim 7, wherein the access panel is sheet metal.

9. The system of claim 7, wherein a surface of the self-clinching magnet is substantially flush with an outer surface of the access panel.

10. The system of claim 9, wherein the surface of the self-clinching magnet that is substantially flush with the outer surface of the access panel is coated with at least one of a powder coating, paint, or putty.

11. The system of claim 7, wherein the computer system is a computer storage system.

12. The system of claim 11, further comprising:

a switch coupled to the cabinet, wherein the switch is configured to detect the presence or absence of the magnetic core of the SCM to detect whether the access panel is open or closed.

13. The system of claim 11, wherein the computer storage system is an automated tape library.

14. A system, comprising:

a magazine comprising a plurality of positions to hold a plurality of distinct computer storage media;

a receiver configured to receive the magazine;

a magnet coupled to the receiver or the magazine;

wherein the magnet is operable to apply a force to the magazine as the magazine is received in the receiver to position the magazine in the receiver.

15. The system of claim 14, wherein the magnet comprises:

an outer shell comprising a clinching portion;

an inner magnetic core; and wherein the clinching portion of the magnet engages an interior of a hole in the receiver or the magazine by physically gripping a sidewall of the hole

16. The system of claim 15, wherein a surface of the magnet is substantially flush with a surface of the receiver or the magazine.

17. The system of claim 14, further comprising a metal plate coupled to the receiver, wherein the magnet is coupled to the metal plate.

18. A method, comprising:

inserting a magazine into a receiver, wherein the magazine is configured to hold at least one computer storage medium and wherein the receiver or the magazine comprises a self-clinching magnet (SCM);

guiding the magazine into alignment using the SCM; and wherein the SCM comprises an outer shell, comprising a clinching portion, and an inner magnetic core, and wherein the clinching portion of the SCM is engaged in an interior of a hole in the receiver or the magazine by physically gripping a sidewall of the hole.

* * * * *